US011781515B1

(12) United States Patent
Weston et al.

(10) Patent No.: US 11,781,515 B1
(45) Date of Patent: Oct. 10, 2023

(54) INTERACTIVE REMOTE START ACCORDING TO ENERGY AVAILABILITY

(71) Applicant: FORD GLOBAL TECHNOLOGIES, LLC, Dearborn, MI (US)

(72) Inventors: Keith Weston, Canton, MI (US); Brendan F. Diamond, Grosse Pointe, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 17/980,228

(22) Filed: Nov. 3, 2022

(51) Int. Cl.
*F02N 11/08* (2006.01)

(52) U.S. Cl.
CPC ..... *F02N 11/0807* (2013.01)

(58) Field of Classification Search
CPC ..... F02N 11/0807
See application file for complete search history.

(56) References Cited

U.S. PATENT DOCUMENTS

| | | | |
|---|---|---|---|
| 7,542,827 | B2 | 6/2009 | Gerard et al. |
| 8,489,085 | B2 | 7/2013 | Simmons |
| 8,538,694 | B2 | 9/2013 | Conway |
| 9,784,229 | B2 | 10/2017 | Holub et al. |
| 10,343,633 | B2 | 7/2019 | Tseng et al. |
| 2016/0305791 | A1 | 10/2016 | Neubecker et al. |
| 2021/0237534 | A1 * | 8/2021 | Badger, II ..... B60L 1/02 |

FOREIGN PATENT DOCUMENTS

| | | | |
|---|---|---|---|
| EP | 2679418 | A1 | 1/2014 |

* cited by examiner

*Primary Examiner* — Jacob M Amick
(74) *Attorney, Agent, or Firm* — Joseph Zone; Brooks Kushman P.C.

(57) ABSTRACT

An interactive remote start function is provided. A remote start request selected from a human machine interface (HMI) of an access application of a mobile device is received to a vehicle. Responsive to an estimated energy consumption of the vehicle exceeding available energy of the vehicle, a plurality of corrective actions are sent to the mobile device to be displayed in the HMI. A selection of one of the plurality of corrective actions is received from the mobile device. The one of the plurality of corrective actions is implemented to mitigate the estimated energy consumption of the vehicle exceeding the available energy of the vehicle.

17 Claims, 8 Drawing Sheets

INTERACTIVE REMOTE START ACCORDING TO ENERGY AVAILABILITY

TECHNICAL FIELD

Aspects of the disclosure generally relate to an interactive remote start function that provides interactive vehicle actions according to energy availability of the vehicle.

BACKGROUND

Vehicle key fobs may be used to allow a user to gain access to a vehicle. Some fob devices operate such that when a button is pressed on the fob, the device sends a code to the vehicle to instruct the vehicle to unlock the vehicle. Passive entry passive start (PEPS) key fobs provide a response to a challenge pulse train sent by the vehicle, where if a proper response is received by the vehicle then the door may be unlocked by a user grasping the door handle.

Phone-as-a-key (PaaK) systems are being introduced to allow users to utilize their phones to unlock a vehicle without requiring a key fob device. These systems may operate similar to a key fob, but where the phone communicates with the vehicle over BLUETOOTH LOW ENERGY (BLE), Ultra-Wide Band (UWB), or other mobile device wireless technologies.

SUMMARY

In a first illustrative embodiment, a vehicle having an interactive remote start function is provided. The vehicle includes one or more vehicle controllers programmed to receive a remote start request selected from a human machine interface (HMI) of an access application of a mobile device; responsive to an estimated energy consumption of the vehicle exceeding available energy of the vehicle, send one or more corrective actions to the mobile device to be displayed in the HMI; and implement at least one of the one or more corrective actions to mitigate the estimated energy consumption of the vehicle exceeding the available energy of the vehicle.

In a second illustrative embodiment, a method for an interactive remote start function is provided. A remote start request selected from a HMI of an access application of a mobile device is received to a vehicle. Responsive to an estimated energy consumption of the vehicle exceeding available energy of the vehicle, a plurality of corrective actions are sent to the mobile device to be displayed in the HMI. A selection of one of the plurality of corrective actions is received from the mobile device. The one of the plurality of corrective actions is implemented to mitigate the estimated energy consumption of the vehicle exceeding the available energy of the vehicle.

In a third illustrative embodiment, a non-transitory computer-readable medium includes instructions for an interactive remote start function that, when executed by one or more controllers of a vehicle, cause the vehicle to perform operations including to receive a remote start request selected from a HMI of an access application of a mobile device; responsive to an estimated energy consumption of the vehicle exceeding available energy of the vehicle, send a plurality of corrective actions to the mobile device to be displayed in the HMI; receive, from the mobile device, a selection of one of the plurality of corrective actions; and implement the one of the plurality of corrective actions to mitigate the estimated energy consumption of the vehicle exceeding the available energy of the vehicle.

DETAILED DESCRIPTION

Figure 1:
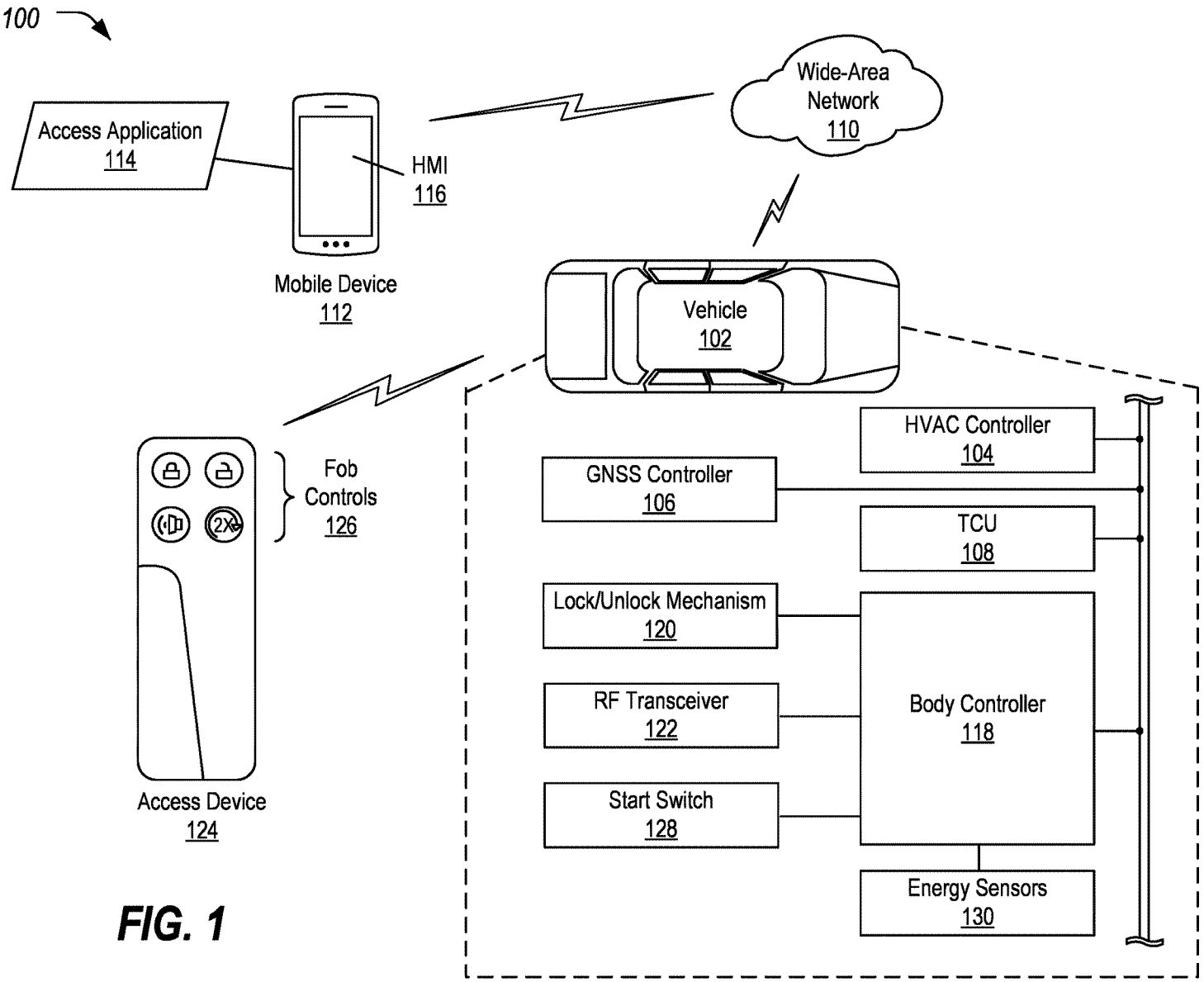
FIG. 1 illustrates an example system for an interactive remote start function that provides vehicle actions according to energy availability of the vehicle.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Some vehicles may be connected to smartphone application to offer the ability to remotely start the vehicle from nearly anywhere. These applications may also offer functions including an ability to see the available energy level of the vehicle (e.g., fuel remaining, battery charge, etc.).

Some vehicles may allow for preconditioning to be performed when a vehicle is remotely started. This may allow, for example the heating, ventilation, and air conditioning (HVAC) system of the vehicle to adjust the temperature of the vehicle cabin to a desired temperature in advance of the user reaching the vehicle. However, such operations reduce the amount of energy that that is available for use in travel. In some cases, this may cause the available energy level to fall below a level required to travel to a destination. This, in turn, may necessitate the vehicle refueling or charging along the trip. It is also possible that remotely starting the vehicle may deplete the energy to a level where it is inconvenient or undesirable to divert to the closest charger or fuel station because that may not be on the intended path of travel. In some cases, a vehicle operator may prefer not to precondition the vehicle to maintain the energy level such that the vehicle may be charged or refueled more conveniently.

When user initiates a remote start command, the vehicle may determine a current status of the vehicle energy level.

The vehicle may also determine a near energy source to the vehicle and a distance to the desired destination. The vehicle may estimate the energy usage corresponding to the remote start request based on various factors, such as current cabin temperature, expected run time (e.g., based on how long the vehicle will take to warm up), desired final temperature, and data regarding the energy efficiency of the HVAC system.

If the energy consumption corresponding to use of the remote start will deplete the energy source such that it is not possible for the vehicle to travel directly to a fuel station, charger, or desired location with a predefined level of confidence and/or energy buffer, the vehicle may perform one or more actions. These actions may include, for example, to alert the user that remote start is disabled, to limit the amount of preconditioning that may be performed, to coordinate when user will arrive at the vehicle to ensure preconditioning is properly timed, and/or to add additional energy stops along the vehicle route. Further aspects of the disclosure are discussed in detail herein.

FIG. 1 illustrates an example system 100 for an interactive remote start function that provides vehicle actions according to energy availability of a vehicle 102. As shown, the system 100 includes a vehicle 102 including an HVAC controller 104, a global navigation satellite system (GNSS) controller 106, and a telematics control unit (TCU) 108. The vehicle 102 may be in communication with a wide-area network 110 via the TCU 108. A mobile device 112 may include an HMI 116 and may be configured to execute an access application 114. The vehicle 102 may further include a body controller 118, in communication with a radio frequency (RF) transceiver 122, a lock/unlock mechanism 120, and a start switch 128. The mobile device 112 may be configured to communicate with the vehicle 102 via the wide-area network 110, and/or directly via the RF transceiver 122. The access application 114 may allow the user to lock or unlock the vehicle 102 as well as remote start the vehicle 102 to initiate preconditioning of the cabin of the vehicle 102.

The vehicle 102 may include various types of automobile, crossover utility vehicle (CUV), sport utility vehicle (SUV), truck, recreational vehicle (RV), boat, plane or other mobile machine for transporting people or goods. Such vehicles 102 may be human-driven or autonomous. In many cases, the vehicle 102 may be powered by an internal combustion engine. As another possibility, the vehicle 102 may be a battery electric vehicle (BEV) powered by one or more electric motors. As a further possibility, the vehicle 102 may be a hybrid electric vehicle (HEV) powered by both an internal combustion engine and one or more electric motors, such as a plug-in hybrid electrical vehicle (PHEV). Alternatively, the vehicle 102 may be an autonomous vehicle (AV). The level of automation may vary between variant levels of driver assistance technology to a fully automatic, driverless vehicle. As the type and configuration of vehicle 102 may vary, the capabilities of the vehicle 102 may correspondingly vary. As some other possibilities, vehicles 102 may have different capabilities with respect to passenger capacity, towing ability and capacity, and storage volume. For title, inventory, and other purposes, vehicles 102 may be associated with unique identifiers, such as vehicle identification numbers (VINs).

The HVAC controller 104 may be configured to control heating and cooling functions of the vehicle 102. In an example, these functions may include the control of an air conditioning system, a blower motor, electric window heaters, HVAC doors to adjust the flow of air into the cabin, and the like. The HVAC controller 104 may receive inputs from various sensors indicative of parameters such as in-car temperature, ambient (outside) air temperature, engine coolant temperature (ECT), discharge air temperature, humidity, and sun load. In some examples, the HVAC controller 104 may receive commands to adjust the temperature of the vehicle cabin from occupants of the vehicle 102. In other examples, the HVAC controller 104 may adjust the climate of the cabin of the vehicle 102 responsive to a remote start operation being performed. For example, a user may specify a preferred temperature for the cabin, and the HVAC controller 104 may utilize the air conditioning and/or heating elements to adjust the cabin temperature to that setting in anticipation of the user reaching the vehicle 102.

The GNSS controller 106 may be configured to provide autonomous geo-spatial positioning for the vehicle 102. As some examples, the GNSS functionality may allow the vehicle 102 to determine its position using one or more satellites, such as those of the global positioning system (GPS), GLONASS, Galileo, Beidou and/or others. This location information may be made available to other components of the vehicle 102.

The TCU 108 may include network hardware configured to facilitate communication between the vehicle 102 and other devices of the system 100. For example, the TCU 108 may include or otherwise access a cellular modem configured to facilitate communication with a wide-area network 110. The wide-area network 110 may one or more interconnected communication networks such as the Internet, a cable television distribution network, a satellite link network, a local area network, and a telephone network, as some non-limiting examples. As another example, the TCU 108 may utilize one or more of BLUETOOTH, UWB, Wi-Fi, or wired universal serial bus (USB) network connectivity to facilitate communication with the wide-area network 110 via a user's mobile device 112. The TCU 108 may be configured to perform various telematics features, such as wireless tracking, diagnostics, routing, and other communications to and from the vehicle 102.

The mobile device 112 may include an access application 114 installed to a memory of the mobile device 112. The access application 114 may allow the user to utilize the mobile device 112 as an access device 124 to provide entry to the vehicle 102. In addition, the access application 114 may be able to receive information from the vehicle 102, e.g., transmitted from the vehicle 102 over the wide-area network 110 using the TCU 108. In an example, the access application 114 may allow the user to receive, from the vehicle 102, information indicative of the position of the vehicle 102, which may be determined by the vehicle 102 using the GNSS controller 106. The access application 114 may be configured to provide information to the HMI 116 of the mobile device 112, such as buttons for controlling the vehicle 102 and/or labels for displaying information received from the vehicle 102.

The vehicle 102 may further include a body controller 118. The body controller 118 may be configured to monitor and control various electronic devices and/or subsystems in the vehicle 102. For example, the body controller 118 may be configured to monitor and/or control the operation of power windows, power mirrors, a passenger detection system, adjustable zone controls, interior and/or exterior lighting controls, the defrost system, mirror heaters, individual zone heaters, and/or steering wheel heaters.

A lock/unlock mechanism 120 may be operably coupled to the body controller 118. The body controller 118 may be configured to allow the body controller 118 to control the lock/unlock mechanism 120 to unlock/lock doors of the vehicle 102. The RF transceiver 122 may also be operably coupled to the body controller 118. The RF transceiver 122 may be configured to allow the body controller 118 to provide access to the vehicle 102 via an access device 124.

The access device 124 may include one or more access controls 126, such as a lock switch and an unlock switch. Accordingly, the body controller 118 may control the lock/unlock mechanism 120 to lock the doors of the vehicle 102 in response to a user depressing a lock access control 126 of the access device 124, and to unlock the doors of the vehicle 102 in response to the user depressing an unlock access control 126 of the access device 124.

The access device 124 may be implemented in connection with a base remote entry system, a PEPS system or a passive anti-theft system (PATS). With the PEPS system, the body controller 118 may control the lock/unlock mechanism 120 to unlock the door in response to the body controller 118 determining that the access device 124 is a predetermined distance away from the vehicle 102. In such a case, the access device 124 automatically (or passively) transmits encrypted RF signals (e.g., without user intervention) in order for the body controller 118 to decrypt (or decode) the RF signals and to determine whether the access device 124 is within the predetermined distance and is authorized. With the PEPS implementation, the access device 124 also generates RF signals which correspond to encoded lock/unlock signals in response to a user depressing a lock access control 126 or an unlock access control 126. In addition, with the PEPS system, a physical key may not be needed to start the vehicle 102. The user in this case may be required to depress the brake pedal switch or perform some predetermined operation prior to depressing a start switch 128 after the user has entered into the vehicle 102. In the PATS implementation, the access device 124 may operate as a conventional key fob in order to lock/unlock the vehicle 102. With the PATS implementation, a physical key blade (not shown) is generally needed to start the vehicle 102. The key may include a RF transmitter embedded therein to authenticate the key to the vehicle 102.

The body controller 118 may be further configured to monitor the state of charge of the batteries of the vehicle 102 and/or the fuel level of gas, diesel, hydrogen, or other fuel that may be used by the vehicle 102. The monitoring may be performed by one of more energy sensors 130 configured to measure battery state of charge, and/or fuel level in fuel tanks of the vehicle 102. This The energy level information may be made available from the body controller 118 to the TCU 108, which in turn may make the information available to other devices, such as the access application 114 of the mobile device 112.

Figure 2:
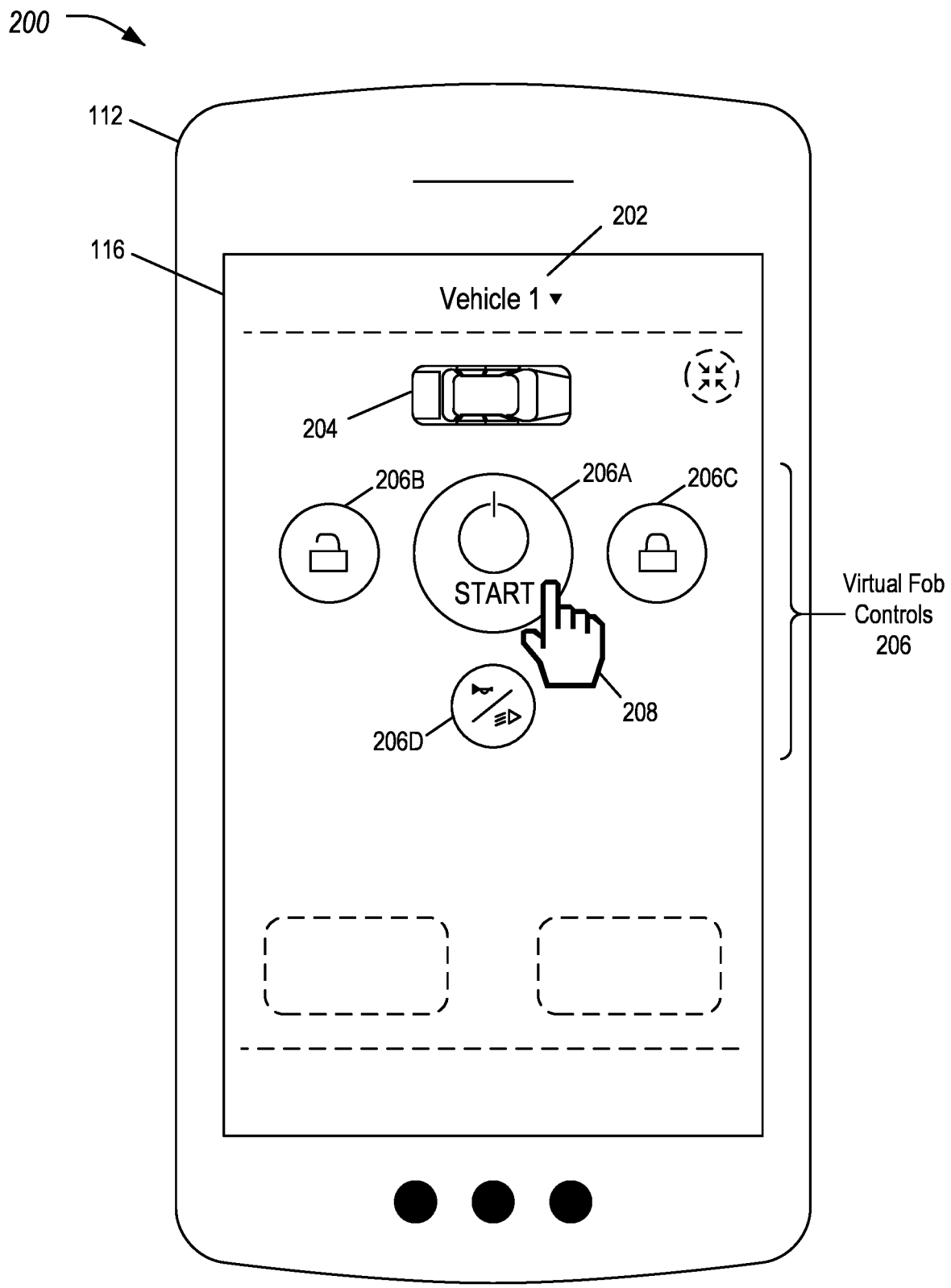
FIG. 2 illustrates an example access screen of the access application displayed to the HMI of the mobile device.

FIG. 2 illustrates an example access screen 200 of the access application 114 displayed to the HMI 116 of the mobile device 112. As shown in an active profile selector 202, the access application 114 is currently configured to control "Vehicle 1". The user may utilize the active profile selector 202 to switch operation of the HMI 116 among different vehicles 102. The access application 114 may further provide an illustration 204 providing a representation of the active vehicle 102. This representation may be an image of the same make, model, and/or color of the active vehicle 102, e.g., to ease in understanding which vehicle 102 is being controlled. The HMI 116 may further include a set of virtual fob controls 206. Similar to the access controls 126 of the access device 124, the virtual fob controls 206 may be configured to provide access functions that, when selected, may be performed to the vehicle 102 indicated as being active in the active profile selector 202.

The virtual fob controls 206 may include a remote start button 206A that, when selected, directs the access application 114 to send a message to the vehicle 102 to attempt to start the vehicle 102. The virtual fob controls 206 may also include an unlock button 206B that, when selected, directs the access application 114 to send a message to the vehicle 102 to attempt to unlock the vehicle 102, and a lock button 206C that, when selected, directs the access application 114 to send a message to the vehicle 102 to attempt to lock the vehicle 102. The virtual fob controls 206 may also include an alarm button 206D that, when selected, directs the access application 114 to send a message to the vehicle 102 to attempt to trigger the vehicle 102 alarm (e.g., to cause the vehicle 102 to flash its lights and/or honk the horn). To perform the requested functions, the access application 114 may direct the mobile device 112 to communicate with the vehicle 102 over the wide-area network 110.

As shown by a hand indication 208, the user may select the remote start button 206A to attempt to start the vehicle 102. By doing so, the vehicle 102 may also be requested to precondition the vehicle 102 cabin in accordance with the user's settings.

Figure 3:
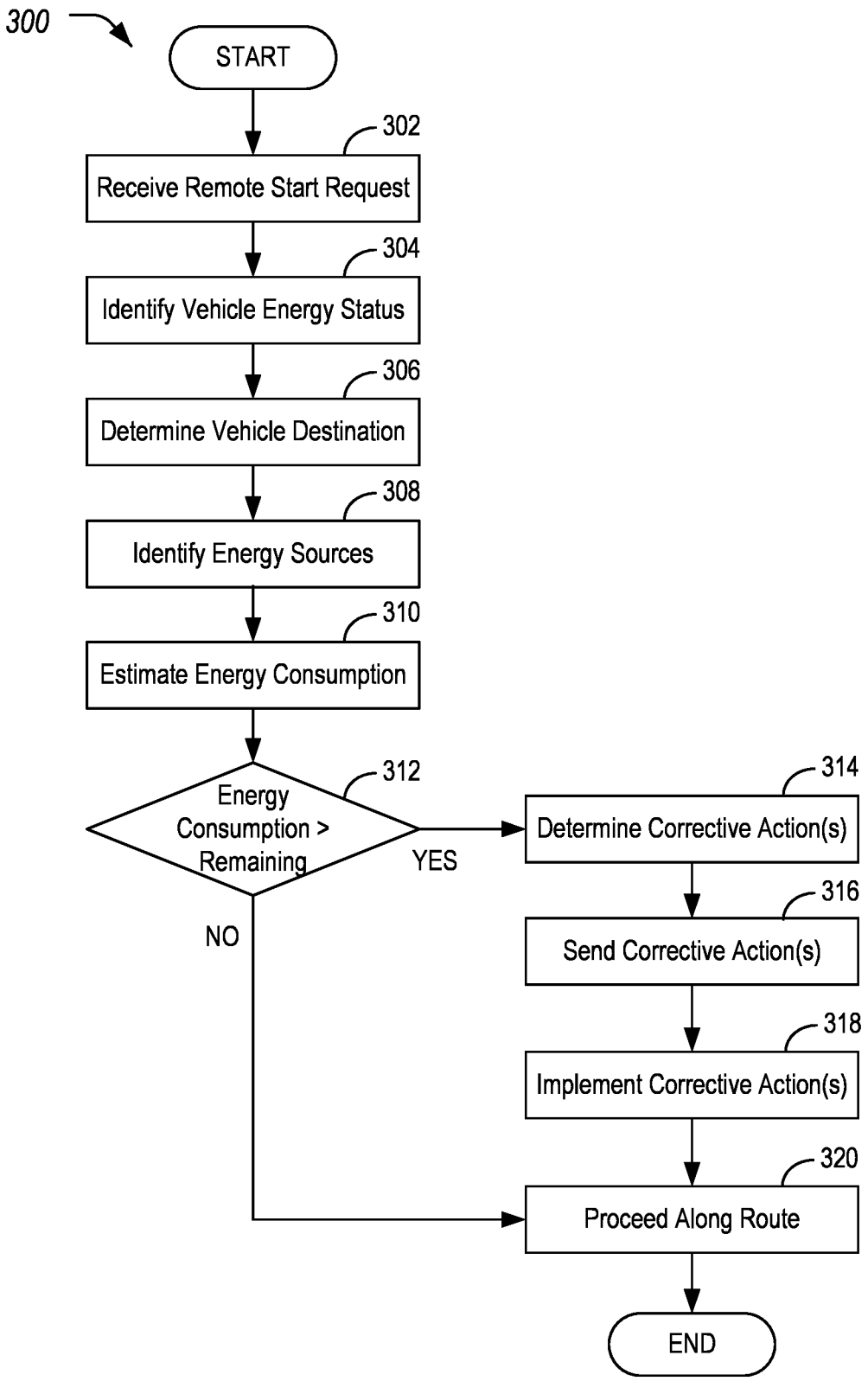
FIG. 3 illustrates an example process for performing an interactive remote start function by the vehicle.

FIG. 3 illustrates an example process 300 for performing an interactive remote start function by the vehicle 102. In an example, the process 300 may be initiated responsive to the vehicle 102 receiving the command to remote start the vehicle 102 responsive to selection of the remote start button 206A. This is shown at operation 302. In an alternate example, the command to remote start the vehicle 102 may be received to the vehicle 102 from the access device 124 (e.g., a key fob).

At operation 304, responsive to the vehicle 102 receiving the request attempting to remote start the vehicle 102, the vehicle 102 may determine a current energy status of the vehicle 102 via the energy sensors 130. For instance, the body controller 118 may monitor the state of charge of the batteries of the vehicle 102 by using one of more energy sensors 130 configured to measure battery state of charge (e.g., by comparing battery voltage to battery discharge curves, etc.). In another example, the body controller 118 may monitor the fuel level of gas, diesel, hydrogen, or other fuel using one of more energy sensors 130 (such as floats, etc.) configured to fuel level in fuel tanks of the vehicle 102. This current status may include, in an example, a distance to empty for the vehicle 102.

At operation 306, the vehicle 102 may determine a destination of the vehicle 102 (e.g., home, a friend's house, a movie theater, etc.). The destination for the vehicle 102 may be determined in various ways. In one example, the vehicle 102 may use vehicle-to-infrastructure (V2I) communication to access a calendar or schedule of the user. In another example, the expected desired location may be inferred based on historical trip data for the vehicle 102 (e.g., repeated trips taken at the same time of day and/or day of the week). In yet a further example, the destination may be entered into the user's mobile device 112 and sent to the vehicle 102.

At operation 308, the vehicle 102 identifies energy sources for the vehicle 102. In an example, the vehicle 102 may identify a nearest charging station and/or fueling station based on a current location of the vehicle 102 determined using the GNSS controller 106. In another example, the vehicle 102 may identify one or more charging stations and/or fueling stations along one or more possible routes of the vehicle 102 from the current location to the destination of the vehicle 102 determined at operation 306.

At operation 310, the vehicle 102 estimate energy usage associated with the remote start request. This may include energy usage for preconditioning the vehicle 102 cabin, as well as energy usage for travel of the vehicle 102 to the destination.

The energy usage for the preconditioning of the vehicle 102 may be determined using information such as the current cabin temperature, expected run time (based on how long the vehicle 102 will take to warm up), desired final temperature, and efficiency of the heating or cooling components controlled by the HVAC controller 104. In an example, a lookup data table may be used to indicate energy requirements as an output based on factors such as initial temperature and desired final temperature. In another example, actual energy required to perform the preconditioning based on factors such as initial temperature and desired final temperature may be used to train a machine learning model to determine the expected energy usage, where at runtime the machine learning model may be used based on the current temperature and desired preconditioning temperature to output the expected energy usage.

The energy usage for the travel of the vehicle 102 to the destination may be determined in various ways as well. In an example, the vehicle 102 may maintain information indicative of historical average energy consumption of the vehicle 102 per distance traveled and may use that average and the distance to the destination to approximate the energy required. In another example, the vehicle 102 may maintain information indicative of historical average energy consumption of the vehicle 102 along specific road segments, and may sum that information along the segments of the route to the destination to approximate the energy required. In yet another example, the vehicle 102 may utilize the TCU 108 to access a server that may compute the energy required and provide a result to the vehicle 102.

At decision point 312, the vehicle 102 determines whether the estimated energy usage from operation 310 exceeds the available energy identified at operation 304. This computation may, in an example, involve a simple comparison of estimated energy usage to available energy. If it is determined that the energy consumption associated with preconditioning the vehicle 102 may deplete the energy of the vehicle 102 such that it is not possible for the vehicle 102 to travel directly to the destination, control passes to operation 314. If it is determined that the energy consumption associated with preconditioning the vehicle 102 is available, then control passes to operation 320.

In another example, a buffer may be used to provide an additional level of confidence for the estimated energy usage. The buffer may be used to provide an additional reserve of energy with respect to the distance to empty algorithm of vehicle 102. The buffer may vary based on factors such as temperature, driving style, and/or recent vehicle 102 energy consumption as well. In an example, the buffer may be 30% of the range at 20 degrees Fahrenheit but may be 5% of the range at 70 degrees Fahrenheit. In yet another example, the buffer may account for the most recent energy consumption of the vehicle 102 to capture if the vehicle 102 was recently loaded with trailer and/or payload that may affect the historical fuel economy of the vehicle 102.

At operation 314, the vehicle 102 determines corrective actions that can be performed to address the lack of energy. In some examples, no corrective action may be available and the vehicle 102 may disable remote start. In other examples, corrective actions may be determined by the vehicle 102, such as to adjust the vehicle route to either a lower energy route or to add a refueling stop to allow for the remote start function of the vehicle 102 to be performed. Or, the preconditioning may be limited in scope to allow for the remote start function to be performed within the energy budget of the vehicle 102.

At operation 316, the vehicle 102 sends the corrective actions based on the lack of energy to the mobile device 112. For instance, responsive to receipt of the remote start request, the vehicle 102 may send a response to the mobile device 112 to cause the access application 114 to display information in the HMI 116 indicating the lack of energy.

Figure 4A:
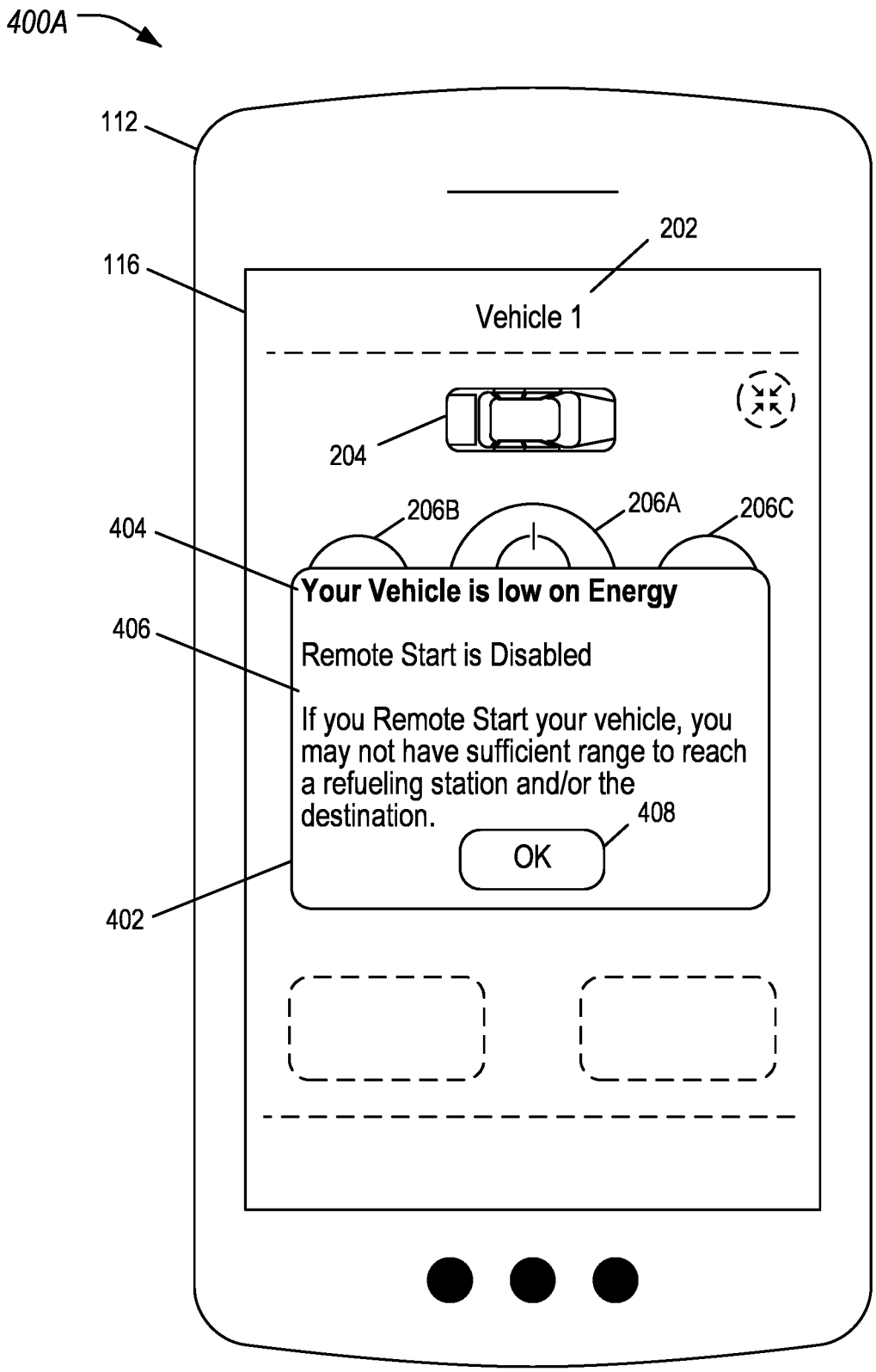
FIG. 4A illustrates an example HMI of the access application of the mobile device indicating that the remote start function of the vehicle is disabled.

In an example, FIG. 4A illustrates an example 400A of the HMI 116 of the access application 114 of the mobile device 112 indicating that the remote start function of the vehicle 102 is disabled. As shown in FIG. 4A, responsive to the vehicle 102 sending the response to the mobile device 112 indicating that remote start is disabled, the access application 114 may display an alert 402 overlaid on the access screen 200. The alert 402 may include a title 404 indicating that the vehicle 102 is low on energy. The alert 402 may further include alert details 406 that, in this instance, indicate that remote start is disabled because if remote start is performed the vehicle 102 may not have sufficient energy to reach the destination (or a refueling station such as a gas station or electric charger). The alert 402 may further include a control 408 that, when selected, dismisses the alert 402. Nevertheless, the user of the mobile device 112 receiving the alert 402 may be able to understand why remote start and/or preconditioning are not being performed.

Figure 4B:
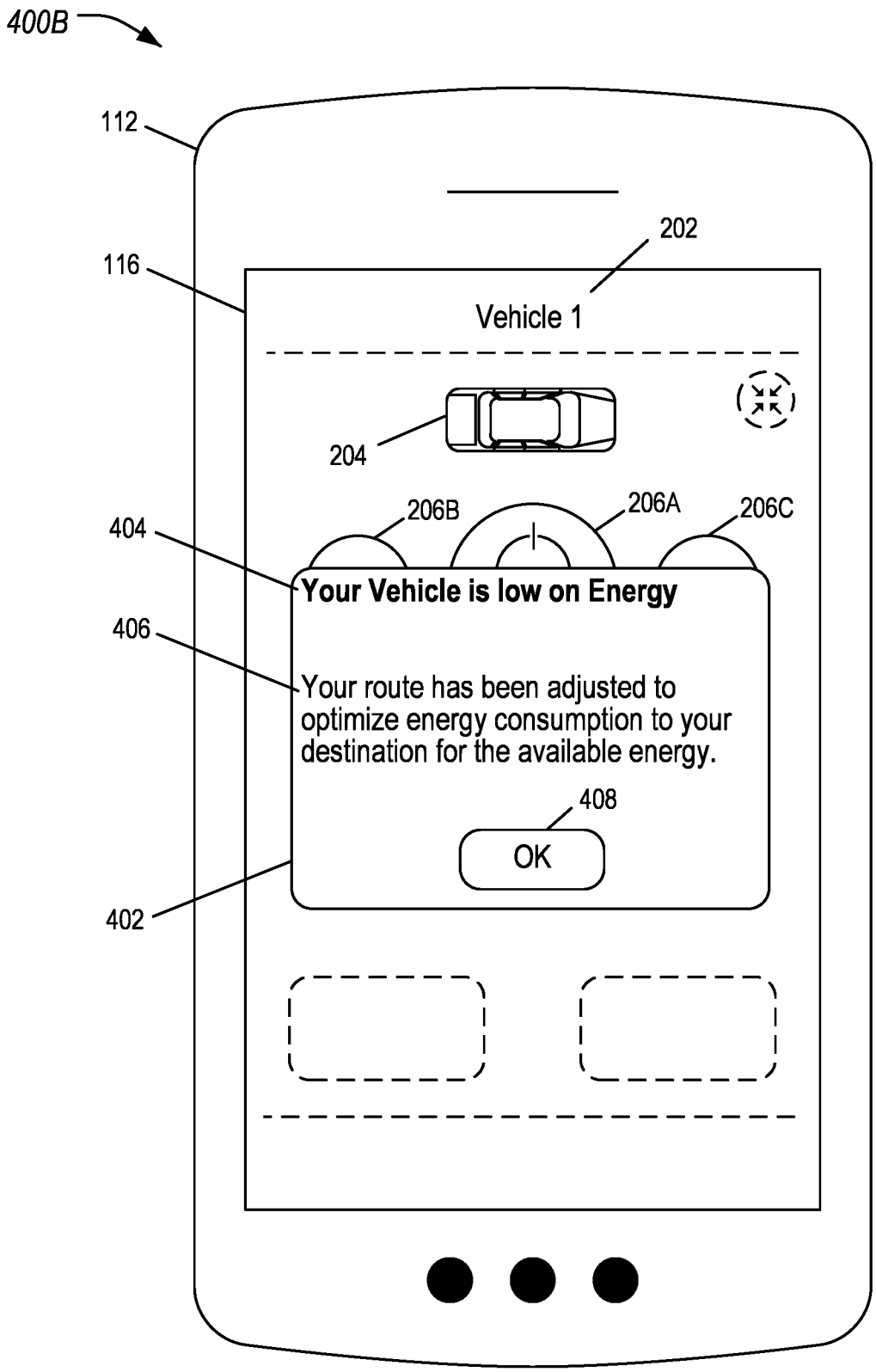
FIG. 4B illustrates an example HMI of the access application of the mobile device indicating that the route has been adjusted to allow for the remote start function of the vehicle to be performed.

In another example, FIG. 4B illustrates an example 400B of the HMI 116 of the access application 114 of the mobile device 112 indicating that the route has been adjusted to allow for the remote start function of the vehicle 102 to be performed. As shown in FIG. 4B, the information may indicate that the route has been adjusted to allow for the remote start function of the vehicle 102 to be performed.

Figure 4C:
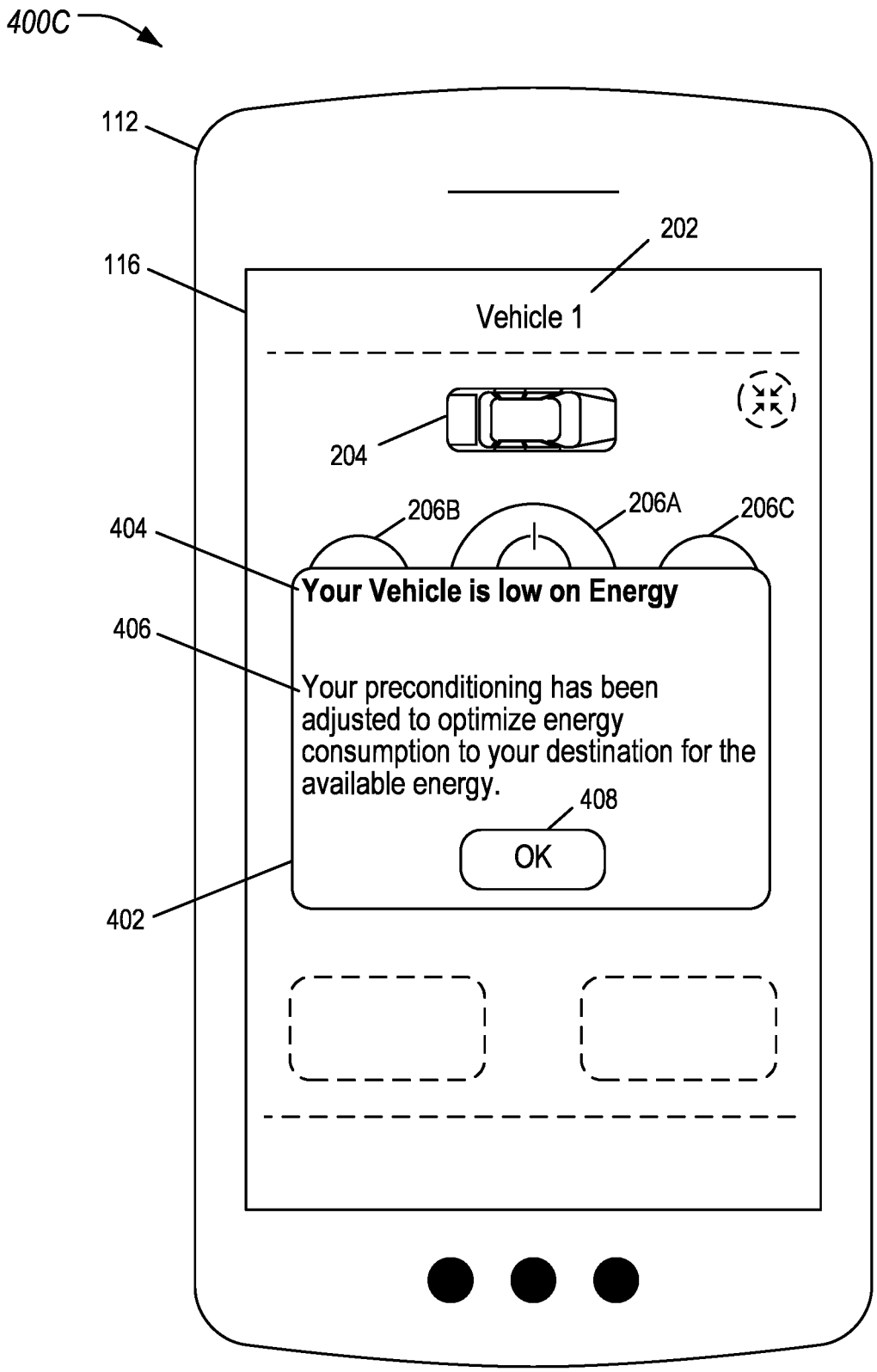
FIG. 4C illustrates an example HMI of the access application of the mobile device indicating that the preconditioning has been adjusted to allow for the remote start function of the vehicle to be performed.

In yet another example, FIG. 4C illustrates an example 400C of the HMI 116 of the access application 114 of the mobile device 112 indicating that the preconditioning has been adjusted to allow for the remote start function of the vehicle 102 to be performed. For example, in such an instance the vehicle 102 may perform preconditioning for a lesser timeframe, or to a less different temperature than specified by the user, to preserve energy capacity of the vehicle 102 for travel.

Referring back to FIG. 3, at operation 318 the vehicle 102 implements the corrective actions. In an example, the vehicle 102 may disallow remote start. Or, the vehicle 102 may add a refueling stop along the route to the destination. Or, the vehicle 102 may reduce the preconditioning that is performed to fit within the energy budget.

Figure 4D:
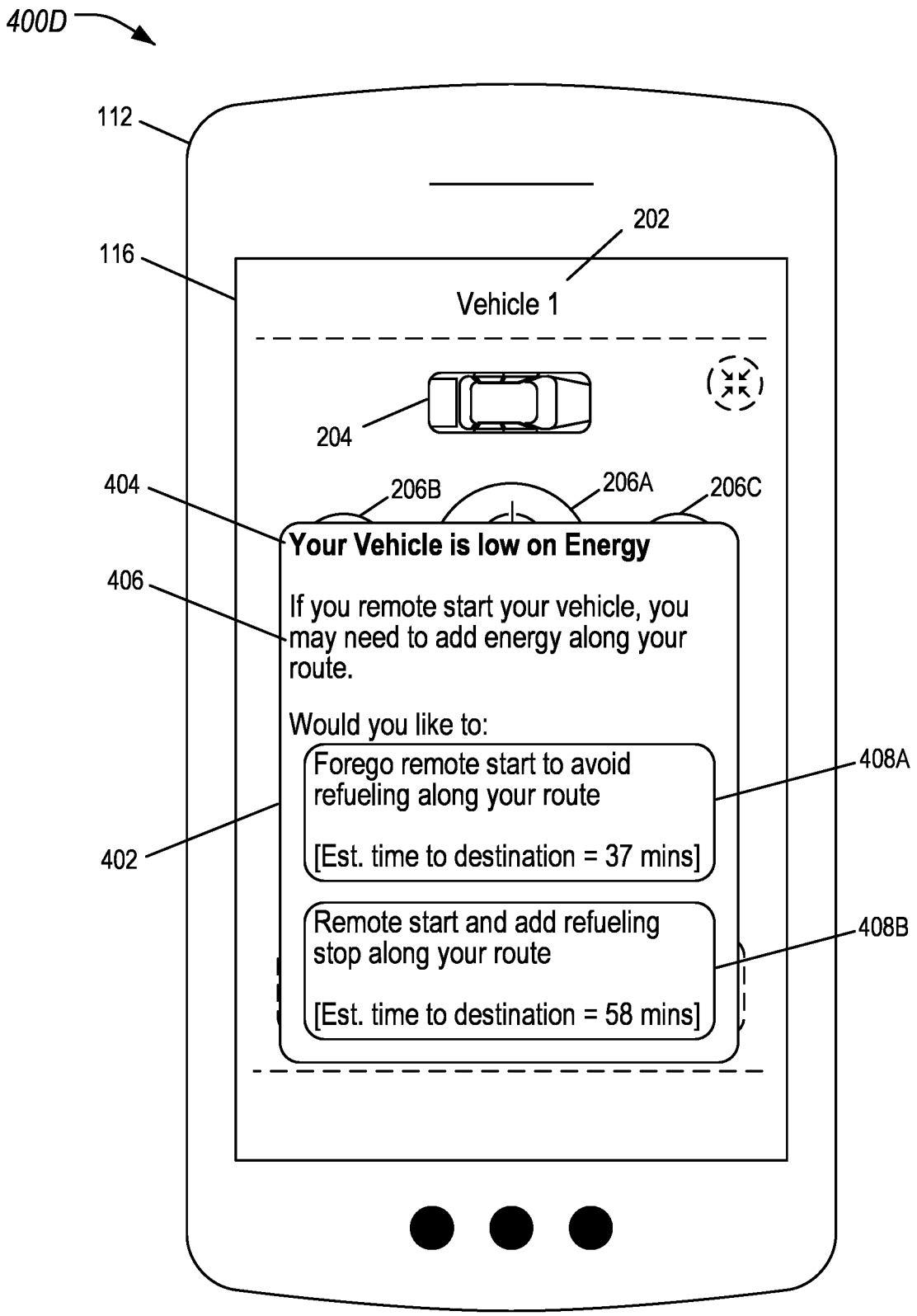
FIG. 4D illustrates an example HMI of the access application of the mobile device indicating remote start options that are available based on the low energy condition of the vehicle.

In still other examples, the corrective action may be automatically determined by the vehicle 102 and indicated to the user. FIG. 4D illustrates an example 400D of the HMI 116 of the access application 114 of the mobile device 112 indicating remote start options 408A, 408B that are available based on the low energy condition of the vehicle 102. As shown in FIG. 4D, the user may be able to select to perform the remote start with an altered route, or not use remote start and continue using the existing route. In such an example, the user selection of the corrective action may be sent from the mobile device 112 back to the vehicle 102 to allow the vehicle 102 to perform the adjusted remote start function. This accordingly provided for an interactive remote start function that provides interactive vehicle 102 actions according to energy availability of the vehicle 102.

At operation 320, the vehicle 102 proceeds along the route in accordance with the corrective actions. In an example, the user may enter the vehicle 102 which is preconditioned according to the energy budget according to the corrective actions, and the vehicle 102 may proceed along the route according to the corrective actions. After operation 320, the process 300 ends.

Figure 5:
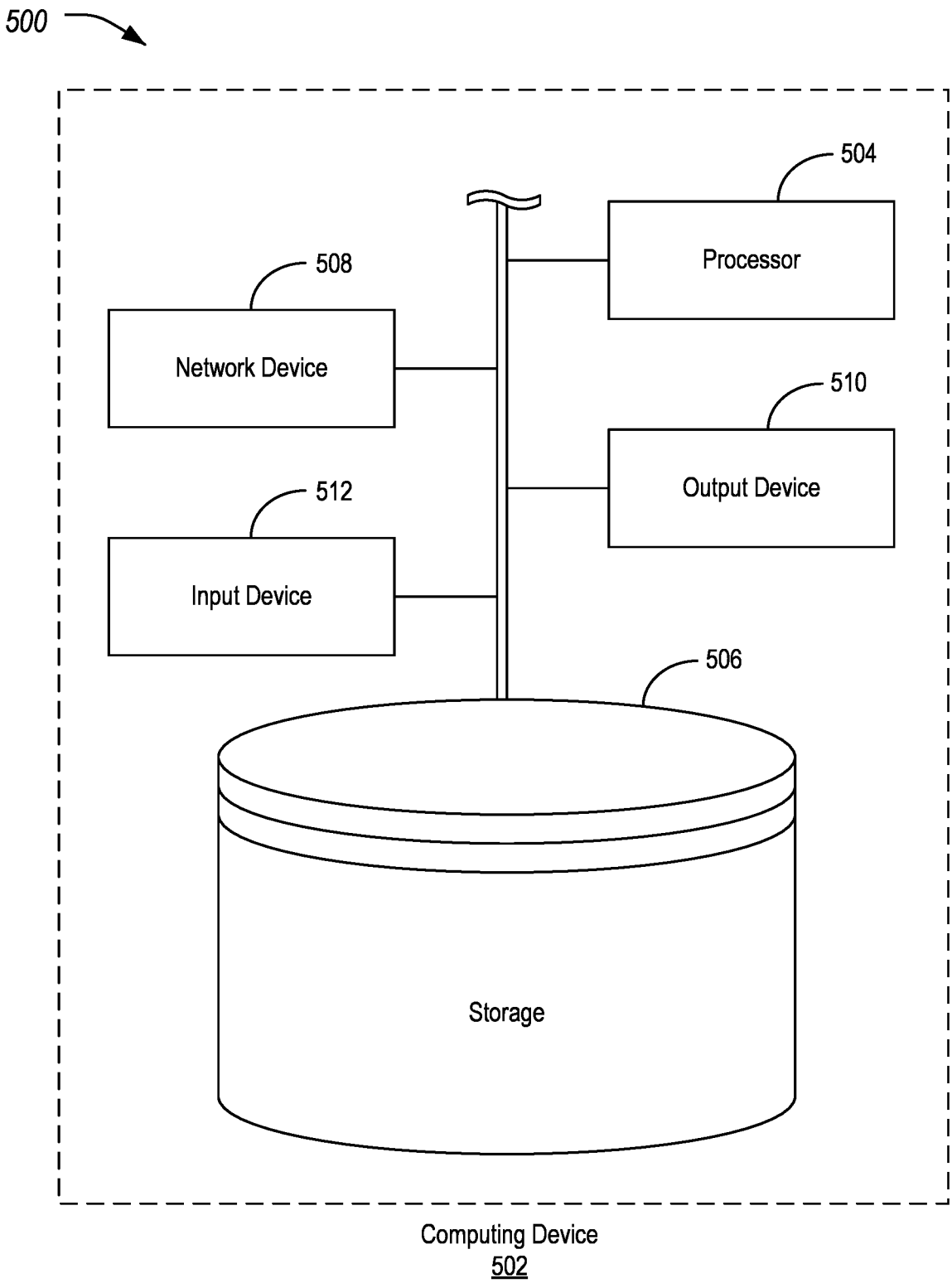
FIG. 5 illustrates an example of a computing device for use in performing an interactive remote start function.

FIG. 5 illustrates an example 500 of a computing device 502 for use in performing an interactive remote start function. Referring to FIG. 5, and with reference to FIGS. 1-4D, the vehicles 102, HVAC controller 104, GNSS controller 106, TCU 108, mobile device 112, body controller 118, RF transceiver 122, and/or access device 124 etc., may include examples of such computing devices 502. As shown, the computing device 502 may include a processor 504 that is operatively connected to a storage 506, a network device 508, an output device 510, and an input device 512. It should be noted that this is merely an example, and computing devices 502 with more, fewer, or different components may be used.

The processor 504 may include one or more integrated circuits that implement the functionality of a central processing unit (CPU) and/or graphics processing unit (GPU). In some examples, the processors 504 are a system on a chip (SoC) that integrates the functionality of the CPU and GPU. The SoC may optionally include other components such as, for example, the storage 506 and the network device 508 into a single integrated device. In other examples, the CPU and GPU are connected to each other via a peripheral connection device such as Peripheral Component Interconnect (PCI) express or another suitable peripheral data connection. In one example, the CPU is a commercially available central processing device that implements an instruction set such as one of the x86, ARM, Power, or Microprocessor without Interlocked Pipeline Stages (MIPS) instruction set families.

Regardless of the specifics, during operation the processor 504 executes stored program instructions that are retrieved from the storage 506. The stored program instructions, accordingly, include software that controls the operation of the processors 504 to perform the operations described herein. The storage 506 may include both non-volatile memory and volatile memory devices. The non-volatile memory includes solid-state memories, such as not and (NAND) flash memory, magnetic and optical storage media, or any other suitable data storage device that retains data when the system is deactivated or loses electrical power. The volatile memory includes static and dynamic random-access memory (RAM) that stores program instructions and data during operation of the system 100.

The GPU may include hardware and software for display of at least two-dimensional (2D) and optionally three-dimensional (3D) graphics to the output device 510. The output device 510 may include a graphical or visual display device, such as an electronic display screen, projector, printer, or any other suitable device that reproduces a graphical display. As another example, the output device 510 may include an audio device, such as a loudspeaker or headphone. As yet a further example, the output device 510 may include a tactile device, such as a mechanically raiseable device that may, in an example, be configured to display braille or another physical output that may be touched to provide information to a user.

The input device 512 may include any of various devices that enable the computing device 502 to receive control input from users. Examples of suitable input devices that receive human interface inputs may include keyboards, mice, trackballs, touchscreens, voice input devices, graphics tablets, and the like.

The network devices 508 may each include any of various devices that enable the vehicles 102, HVAC controller 104, GNSS controller 106, TCU 108, mobile device 112, body controller 118, RF transceiver 122, and/or access device 124 to send and/or receive data from external devices over networks (such as the communications network). Examples of suitable network devices 508 include an Ethernet interface, a Wi-Fi transceiver, a cellular transceiver, a satellite transceiver, a vehicle-to-everything (V2X) transceiver, a BLUETOOTH or BLE transceiver, or other network adapter or peripheral interconnection device that receives data from another computer or external data storage device, which can be useful for receiving large sets of data in an efficient manner.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to strength, durability, life cycle, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A vehicle having an interactive remote start function comprising:

one or more vehicle controllers programmed to:

receive a remote start request selected from a human machine interface (HMI) of an access application of a mobile device;

identify a destination of the vehicle, a current location of the vehicle, a shortest route of the vehicle from the current location to the destination, and compute an estimated energy consumption of the vehicle based on the shortest route, including to sum a first energy usage for travel of the vehicle to the destination along the shortest route and a second energy usage for preconditioning of the vehicle;

responsive to the estimated energy consumption of the vehicle exceeding available energy of the vehicle, send one or more corrective actions to the mobile device to be displayed in the HMI; and implement at least one of the one or more corrective actions to mitigate the estimated energy consumption of the vehicle exceeding the available energy of the vehicle.

2. The vehicle of claim 1, wherein the one or more corrective actions include at least two of to forego remote start, to use remote start with adding a refueling stop, to reduce preconditioning of the vehicle, or to forego preconditioning of the vehicle.

3. The vehicle of claim 2, wherein the one or more vehicle controllers are further programmed to:

receive, from the mobile device, a selection of one of the one or more corrective actions, and implement the one of the one or more corrective actions responsive to receipt of the selection.

4. The vehicle of claim 1, wherein to determine the estimated energy consumption further includes to apply a buffer to the estimated energy consumption to provide an additional reserve of energy, wherein the amount of the buffer varies based on factors including temperature, driving style, and/or recent vehicle energy consumption.

5. The vehicle of claim 1, wherein the one or more corrective actions include to adjust the shortest route to a more fuel efficient route.

6. The vehicle of claim 1, wherein the one or more corrective actions include to reduce the second energy usage for the preconditioning of the vehicle such that the estimated energy consumption is less than the available energy of the vehicle.

7. The vehicle of claim 1, wherein the one or more corrective actions include to disable remote start.

8. A method for an interactive remote start function comprising:

receiving, to a vehicle, a remote start request selected from a human machine interface (HMI) of an access application of a mobile device;

identifying a destination of the vehicle, a current location of the vehicle, a shortest route of the vehicle from the current location to the destination, and computing an estimated energy consumption of the vehicle based on the shortest route, including to sum a first energy usage for travel of the vehicle to the destination along the shortest route and a second energy usage for preconditioning of the vehicle;

responsive to the estimated energy consumption of the vehicle exceeding available energy of the vehicle, sending a plurality of corrective actions to the mobile device to be displayed in the HMI;

receiving, from the mobile device, a selection of one of the plurality of corrective actions; and implementing the one of the plurality of corrective actions to mitigate the estimated energy consumption of the vehicle exceeding the available energy of the vehicle.

9. The method of claim 8, wherein the plurality of corrective actions include at least two of to forego remote start, to use remote start with adding a refueling stop, to reduce preconditioning of the vehicle, or to forego preconditioning of the vehicle.

10. The method of claim 8, wherein determining the estimated energy consumption further includes applying a buffer to the estimated energy consumption to provide an additional reserve of energy, wherein the amount of the buffer varies based on factors including temperature, driving style, and/or recent vehicle energy consumption.

11. The method of claim 8, wherein the plurality of corrective actions includes to adjust the shortest route to a more fuel efficient route.

12. The method of claim 8, wherein the plurality of corrective actions includes to reduce the second energy usage for the preconditioning of the vehicle such that the estimated energy consumption is less than the available energy of the vehicle.

13. A non-transitory computer-readable medium comprising instructions for an interactive remote start function that, when executed by one or more controllers of a vehicle, cause the vehicle to perform operations including to:

receive a remote start request selected from a human machine interface (HMI) of an access application of a mobile device;

identify a destination of the vehicle, a current location of the vehicle, a shortest route of the vehicle from the current location to the destination, and compute an estimated energy consumption of the vehicle based on the shortest route, including to sum a first energy usage for travel of the vehicle to the destination along the shortest route and a second energy usage for preconditioning of the vehicle;

responsive to the estimated energy consumption of the vehicle exceeding available energy of the vehicle, send a plurality of corrective actions to the mobile device to be displayed in the HMI;

receive, from the mobile device, a selection of one of the plurality of corrective actions; and implement the one of the plurality of corrective actions to mitigate the estimated energy consumption of the vehicle exceeding the available energy of the vehicle.

14. The medium of claim 13, wherein the plurality of corrective actions include at least two of to forego remote start, to use remote start with adding a refueling stop, to reduce preconditioning of the vehicle, or to forego preconditioning of the vehicle.

15. The medium of claim 13, wherein to determine the estimated energy consumption further includes applying a buffer to the estimated energy consumption to provide an additional reserve of energy, wherein the amount of the buffer varies based on factors including temperature, driving style, and/or recent vehicle energy consumption.

16. The medium of claim 13, wherein the plurality of corrective actions includes to adjust the shortest route to a more fuel efficient route.

17. The medium of claim 13, wherein the plurality of corrective actions includes to reduce the second energy usage for the preconditioning of the vehicle such that the estimated energy consumption is less than the available energy of the vehicle.

* * * * *